US005819663A

United States Patent [19]

Klaas et al.

[11] Patent Number: 5,819,663

[45] Date of Patent: Oct. 13, 1998

[54] GRIPPER CONVEYOR WITH PRELIMINARY INK JET

[75] Inventors: Lawrence S. Klaas, Brookfield; Dave Christofferson, Sussex, both of Wis.

[73] Assignee: Quad/Tech, Inc., Sussex, Wis.

[21] Appl. No.: 524,240

[22] Filed: Sep. 6, 1995

[51] Int. Cl.[6] ..... B41F 5/00

[52] U.S. Cl. ..... 101/483; 271/11; 271/202; 271/216; 271/204; 270/1.01; 270/58.01; 270/58.3; 101/232

[58] Field of Search ..... 101/232, 240, 101/483, 183; 270/1.01, 1.02, 45, 48, 52.26, 52.29, 58.3, 58.01; 271/204, 277, 34, 307, 309, 245, 11, 202, 216

[56] References Cited

U.S. PATENT DOCUMENTS

| | | | |
|---|---|---|---|
| 3,881,718 | 5/1975 | Fernandez-Rana et al. | 271/150 |
| 3,897,053 | 7/1975 | Guy . | |
| 3,964,598 | 6/1976 | Alsop . | |
| 4,139,190 | 2/1979 | Keyt et al. | 271/277 |
| 4,149,711 | 4/1979 | Jackson | 270/52.29 |
| 4,168,828 | 9/1979 | McLear | 270/52.29 |
| 4,320,894 | 3/1982 | Reist et al. | 271/277 |
| 4,393,386 | 7/1983 | Di Giulio . | |
| 4,424,965 | 1/1984 | Faltin | 271/202 |
| 4,482,142 | 11/1984 | McCain et al. | 270/52.26 |
| 4,531,722 | 7/1985 | Woerner | 270/48 |
| 4,538,161 | 8/1985 | Reist . | |
| 4,585,227 | 4/1986 | Müller | 271/202 |
| 4,604,851 | 8/1986 | Reist | 271/204 |
| 4,606,173 | 8/1986 | Meier | 271/204 |
| 4,629,175 | 12/1986 | Fischer et al. . | |
| 4,678,172 | 7/1987 | Faltin . | |
| 4,747,817 | 5/1988 | Newsome | 270/58.3 |
| 4,750,732 | 6/1988 | Hara et al. . | |
| 4,762,065 | 8/1988 | Nothmann | 101/409 |
| 4,867,432 | 9/1989 | Matta | 271/11 |
| 4,895,360 | 1/1990 | Reist . | |
| 4,898,373 | 2/1990 | Newsome | 270/58.3 |
| 4,983,990 | 1/1991 | Frohlich . | |
| 5,005,815 | 4/1991 | Auksi . | |
| 5,013,022 | 5/1991 | Graushar . | |
| 5,025,610 | 6/1991 | Graushar . | |
| 5,029,830 | 7/1991 | Quadracci . | |
| 5,080,337 | 1/1992 | Mayer et al. . | |
| 5,094,554 | 3/1992 | Hurd et al. . | |
| 5,100,116 | 3/1992 | Graushar . | |
| 5,101,224 | 3/1992 | Freed, Jr. . | |
| 5,106,068 | 4/1992 | Honegger . | |
| 5,110,116 | 5/1992 | Kobler et al. | 271/204 |
| 5,125,334 | 6/1992 | Marx et al. | 101/183 |
| 5,158,278 | 10/1992 | Mauer | 271/202 |
| 5,201,397 | 4/1993 | Isaacs . | |
| 5,257,777 | 11/1993 | Kalika et al. . | |
| 5,375,827 | 12/1994 | Lentz et al. . | |
| 5,386,984 | 2/1995 | Dal Toso et al. . | |
| 5,398,920 | 3/1995 | Leu | 271/216 |
| 5,443,256 | 8/1995 | Ertavi | 271/277 |

FOREIGN PATENT DOCUMENTS

| | | |
|---|---|---|
| 0 534 337 | 3/1993 | European Pat. Off. . |
| 469309 | 7/1937 | United Kingdom . |
| 504085 | 4/1939 | United Kingdom . |
| 890159 | 2/1962 | United Kingdom . |
| 1 278 560 | 6/1972 | United Kingdom . |
| 2 187 419 | 9/1987 | United Kingdom . |

*Primary Examiner*—Eugene H. Eickholt
*Attorney, Agent, or Firm*—Michael, Best & Friedrich

[57] ABSTRACT

An apparatus for providing printed products to a gatherer, including a product supplier for feeding printed products, a product separator positioned to receive printed products from the product supplier and to separate the printed products into a separated stream, a printer positioned adjacent to the separated stream and positioned to print on the separated printed products, and a gripper conveyor positioned to receive the separated printed products from the printer and to form a shingled stream.

35 Claims, 4 Drawing Sheets

GRIPPER CONVEYOR WITH PRELIMINARY INK JET

FIELD OF THE INVENTION

The present invention relates generally to the field of printing, such as the printing and production of magazines formed by multiple signatures. More specifically, the invention relates to methods and apparatus for printing and gathering signatures.

BACKGROUND OF THE INVENTION

The printing industry has recognized the need for flexibility in producing different versions of the same publication to be mailed to users in the same geographical location, and the value of printing personalized messages (e.g. directed to a specific consumer or group of consumers) on each publication. Ink jet printing is commonly used for producing such personalized messages in these publications.

One method of conveying printed products uses a gripper conveyor. A gripper conveyor includes a plurality of gripper elements that accommodate a plurality of single printed products in shingled (i.e. overlapping) relation. These gripper conveyors are particularly useful because they are capable of conveying printed products at a high rate. However, when printed products are conveyed by such gripper conveyors, ink jet printing is limited to the exposed, non-overlapped portion of the product, as is generally described in U.S. Pat. No. 4,538,161.

U.S. Pat. No. 5,100,116 discloses an apparatus that can print on the full page of signatures. The disclosed printing apparatus removes signatures from a stack and separates the signatures for printing. The signatures are subsequently fed to a collating conveyor where the signatures are gathered to form a book block.

SUMMARY OF THE INVENTION

The present invention provides the flexibility of ink jet printing on an entire printed product while maintaining the high output rate of gripper conveyors. To do this, the present invention provides an accelerating and printing apparatus that accommodates ink jet printing on the full page of each product conveyed. At the same time, the invention further provides a gripper conveyor that conveys printed products at a much higher rate and, combined with the accelerating and printing apparatus, accommodates printing on the full page of the printed product.

The present invention includes an apparatus for providing printed products to a gatherer. The apparatus includes a product supplier for feeding printed products, a product accelerator positioned to receive printed products from the product supplier and to separate the printed products into a separated stream, a printer positioned adjacent to the separated stream and positioned to print on the separated printed products, and a gripper conveyor positioned to receive the separated printed products from the printer and to form a shingled stream. The gripper conveyor is positioned to provide the shingled products to the gatherer.

In one embodiment, the printed products are supplied to the product accelerator at a first speed, and the product accelerator includes an accelerator belt moving at a second speed greater than the first speed. The product accelerator can further include an additional accelerator belt moving at a speed greater than the second speed. In another embodiment, the printer is an ink jet printer, preferably one positioned on either side of the separated stream to allow for printing on both sides of the printed products. A lower guide can be positioned to support the printed products as the printed products are fed from the printer to the gripper conveyor. In addition, or alternatively, a leading edge guide can be positioned to guide a leading edge of the printed products into the gripper conveyor. Preferably, the leading edge guide is spaced from the lower guide. In another embodiment, the apparatus further includes means for deflecting a trailing edge of the printed products. Preferably, the means for deflecting includes an air guide operatively positioned between the printer and the gripper conveyor.

The present invention also provides a method of providing printed products to a gatherer. The method includes the steps of accelerating the printed products into a separated stream, printing on the printed products while the printed products are separated in the separated stream, receiving the printed products into a gripper conveyor, decelerating the printed products into a shingled stream, and providing the printed products to a gatherer.

In one embodiment, the step of accelerating the printed products includes the steps of feeding the printed products in a shingled stream, and separating the printed products to form a separated stream. In addition, or alternatively, the step of accelerating the printed products can include the step of positioning the printed products between an accelerator belt and a pinch belt. The step of receiving the printed products preferably includes the step of feeding the printed products over a lower guide, and further preferably includes the step of feeding the printed products over a leading edge guide. In another embodiment, the step of receiving the printed products includes the step of deflecting a trailing edge of the printed products.

DETAILED DESCRIPTION

Figure 1:
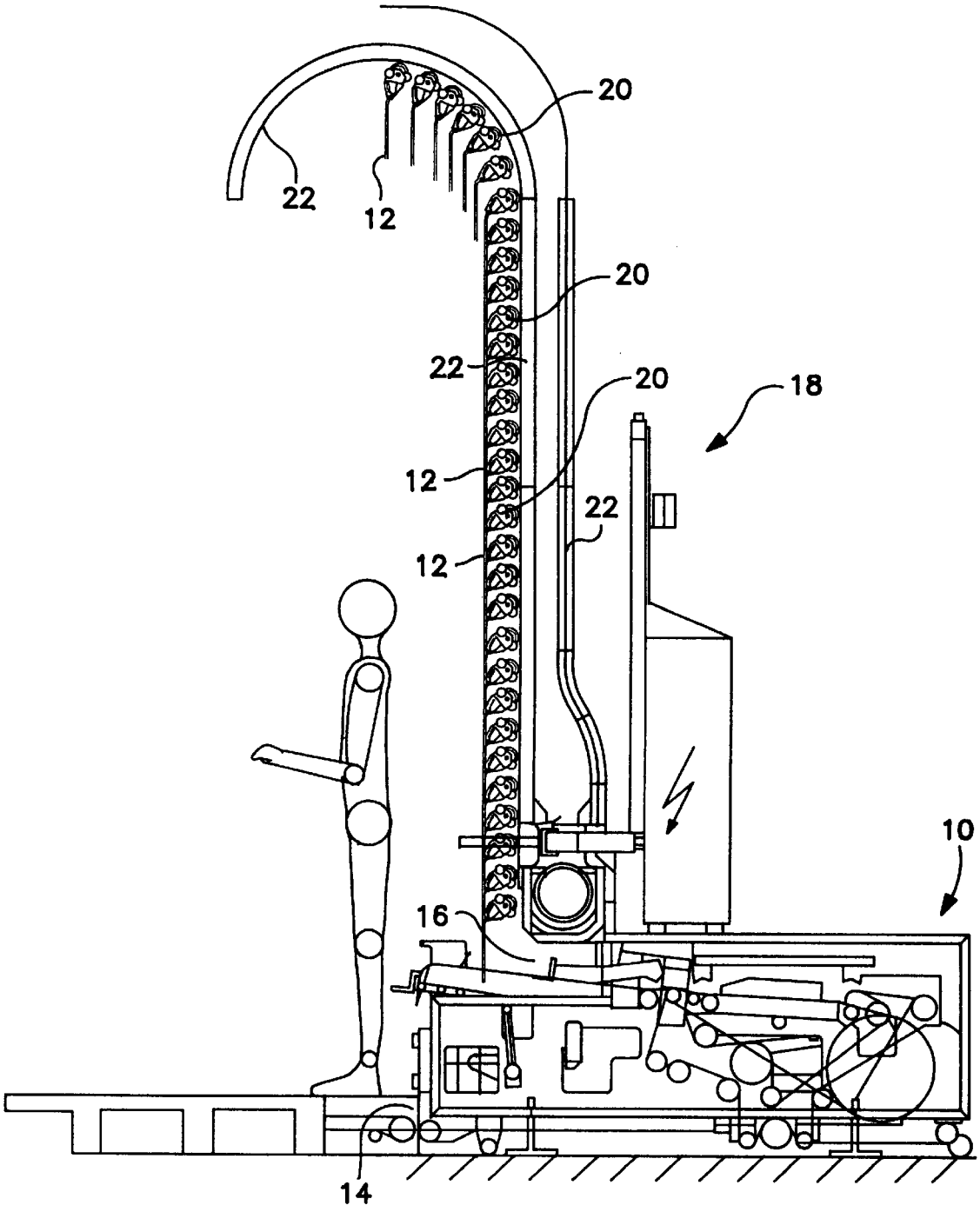
FIG. 1 (PRIOR ART)
FIG. 1 is a side elevation view of a prior art feeder and gripper conveyor.

The prior device shown in FIG. 1 includes a high speed feeder 10 that receives a stream of shingled, folded signatures at an infeed area 14. The illustrated high speed feeder is a Ferag ZF Feeder available from Ferag AG of Hinwil, Switzerland. The stream can be provided, for example, by a conventional manual supplier (not shown) such as a Ferag HDA Supplier available from Ferag AG. The shingled stream is supplied to the high speed feeder 10 with the folded edges of the signatures oriented upstream (i.e., toward the direction of travel). The high speed feeder 10 transports the signatures to an outfeed area 16 to form a stack of signatures with the stream being fed into the bottom of the stack. The high speed feeder includes an engaging device that lifts the top signature off of the stack and feeds the signature 12 to an adjacent gripper conveyor 18.

The gripper conveyor 18 includes a plurality of gripper elements 20 that travel along a track 22. As each signature 12 enters the gripper conveyor 18, a gripper element 20 grips the signature 12. A following signature 12 is gripped by a following gripper element 20 that is positioned a short distance form the preceding gripper element so that the signatures 12 are maintained in shingled relation. The gripper conveyor 18 then conveys the shingled signatures 12 to a gatherer (not shown in FIG. 1) that gathers the signatures 12 into a book block. The illustrated gripper conveyor is a Ferag UTR Gripper Conveyor, available from Ferag AG.

Figure 2:
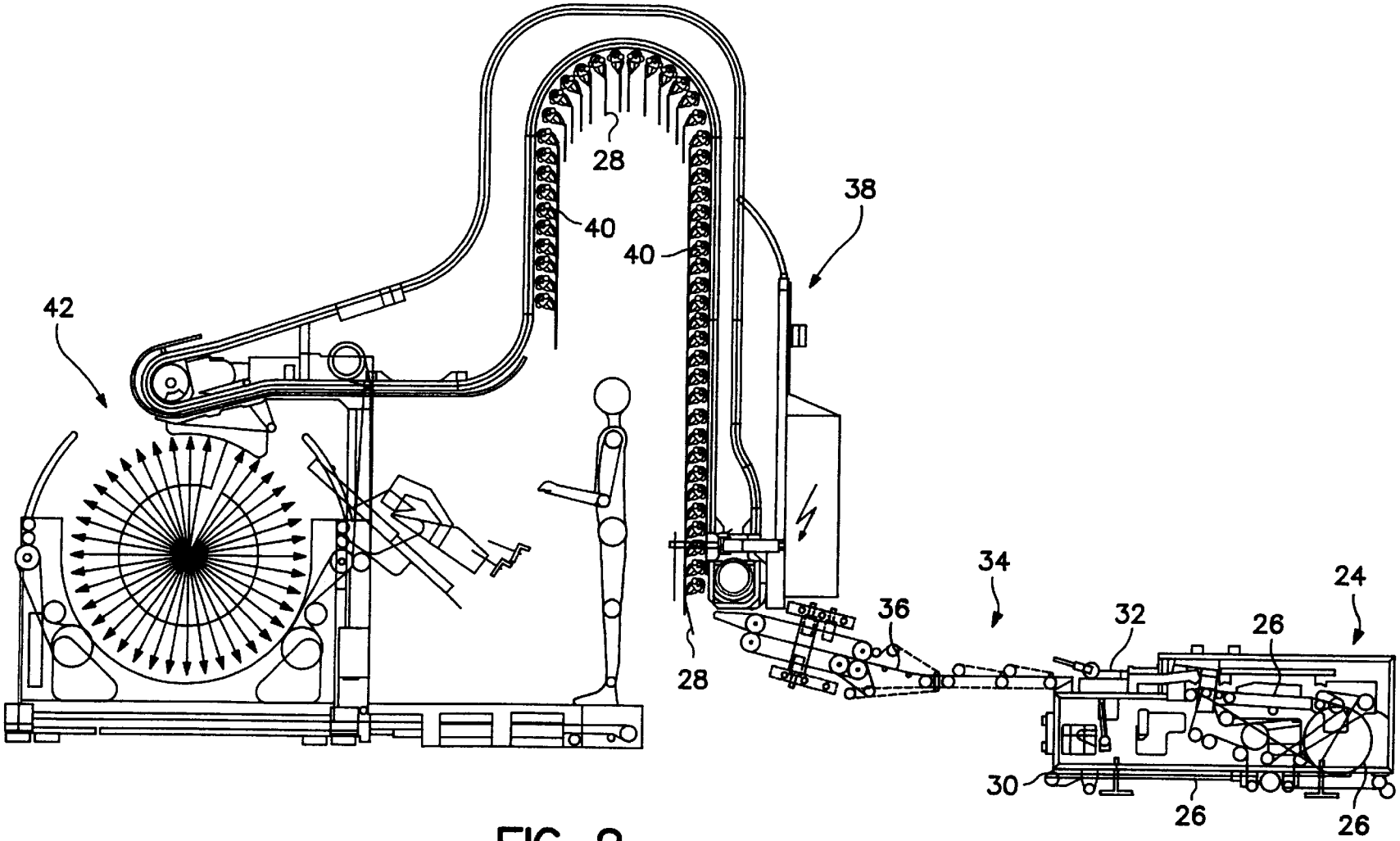
FIG. 2 is a side elevation view of a gripper conveyor device embodying the present invention.

FIG. 2 illustrates an apparatus embodying the present invention. The illustrated apparatus includes a high speed feeder 24 that is supplied with a shingled stream 26 of signatures 28 at an infeed area 30 and provides the signatures to an outfeed area 32. Instead of forming a stack at the outfeed area 32, the illustrated apparatus feeds the shingled signatures directly to an accelerating and printing device 34 positioned adjacent the outfeed area 32 of the high speed feeder 24. It should be appreciated that other types of feeders could be used for the present invention, such as folder style feeders, stack feeders, or high-speed multiform feeders.

The accelerating and printing device 34 separates the shingled stream 26 into a separated stream 36 so that the signatures 28 do not overlap. The accelerating and printing apparatus 34 prints onto each separated signature 28, and then feeds the separated stream 36 to an adjacent gripper conveyor 38. Such feeding to the gripper conveyor 38 causes deceleration of the signatures 28, thereby resulting in the signatures being formed back into a shingled stream 40. The signatures are subsequently fed to an appropriate gatherer 42, such as a Ferag SHT Gatherer available from Ferag AG.

Figure 4:
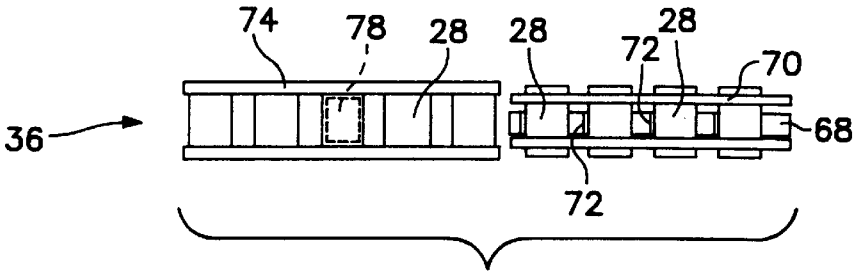
FIG. 4 is a top plan view of the accelerating and printing apparatus illustrated in FIG. 3.
Figure 3:
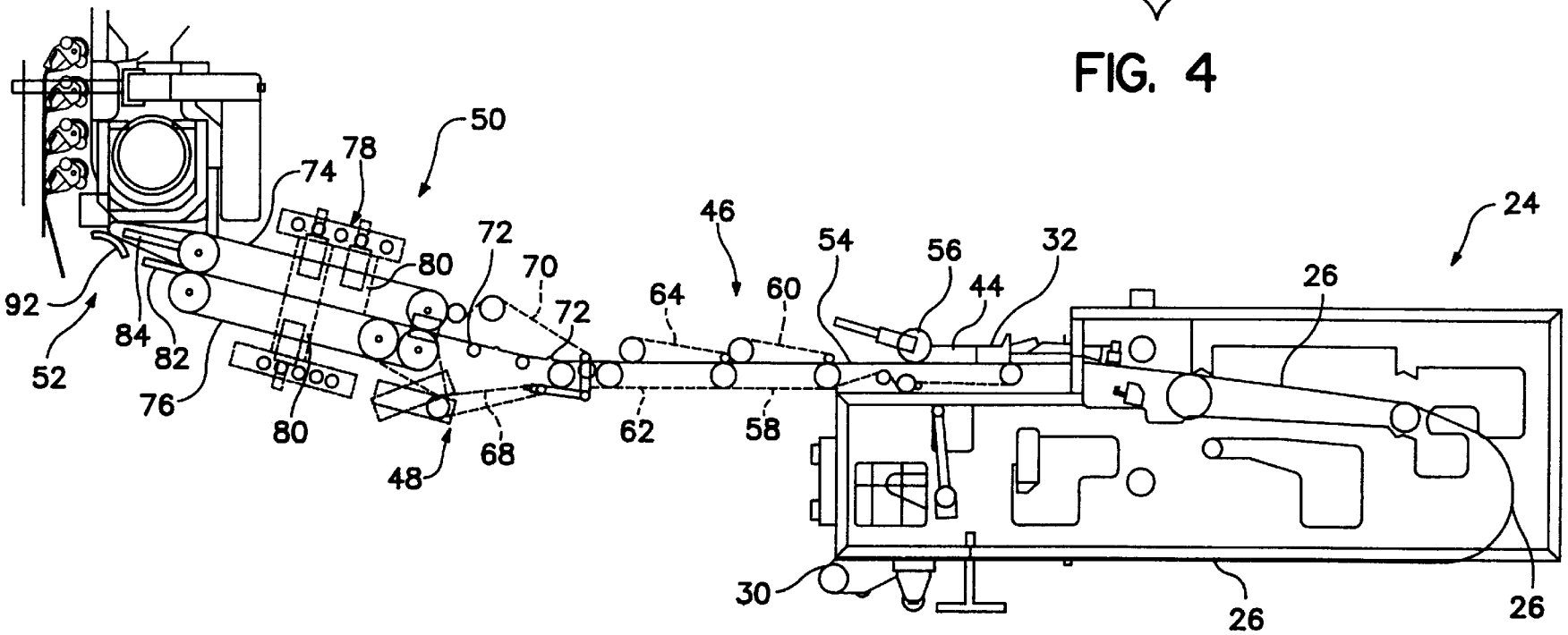
FIG. 3 is an enlarged side elevation view of the feeder and the accelerating and printing apparatus of the device illustrated in FIG. 2.

Referring to FIGS. 3 and 4, the outfeed area 32 of the high speed feeder 24 includes side guides 44 extending from the outfeed area 32 to the accelerating and printing apparatus 34. The side guides 44 are generally in parallel relation to each other and to the path of the shingled stream 26. The side guides 44 are positioned a distance from each other approximately equal to the width of a signature 28 to thereby maintain lateral registration of the signatures during printing operations.

The accelerating and printing apparatus 34 includes an accelerator device 46, a registration device 48, a printer device 50, and a gripper entry device 52. The accelerator device 46 is positioned adjacent to the outfeed area 32 of the high speed feeder 24 and is designed to receive the signatures 28 directly from the high speed feeder 24. The accelerator device 46 includes a transport belt 54, a roller 56, a first accelerating belt 58, a first pinch belt 60, a second accelerating belt 62, and a second pinch belt 64. The transport belt 54 is positioned adjacent to the output area 32 so that the shingled stream 26 can be positioned onto the transport belt 54 and between the side guides 44. The roller 56 provides downward force to the signatures to maintain contact with the transport belt 54. The transport belt 54 rotates clockwise at approximately the same speed as the shingled stream 26 being fed thereto.

The first accelerating belt 58 and associated first pinch belt 60 are designed to receive signatures 28, one at a time, from the transport belt 54 and to accelerate each signature 28 to about three times its incoming speed. In this regard, the first accelerating belt 58 and associated first pinch belt 60 rotate to produce a surface speed that is about three time faster than the surface speed of the transport belt 54.

In a similar sense, the second accelerating belt 62 and associated second pinch belt 64 are designed to receive signatures, one at a time, from the first accelerating belt 58 and associated first pinch belt 60 and to accelerate each signature 28 to about three times its incoming speed. In this regard, the second accelerating belt 62 and associated second pinch belt 64 rotate to produce a surface speed that is about three time faster than the surface speed of the first accelerating belt 58 and associated first pinch belt 60, thereby resulting in a product speed that is about nine times faster than that provided by the high speed feeder 24.

The above-described accelerator belts are of conventional design and do not require further discussion.

The registration device 48 includes a lugged registration belt 68 and a speeder belt 70 positioned above the registration belt. The lugged registration belt 68 includes a plurality of registration lugs 72 that extend outward from the registration belt 68 and that are separated from each other by a distance greater than the length of a signature 28. The lugged registration belt 68 rotates at a speed that is about equal to the speed of the second accelerating belt 62. The speeder belt 70 is positioned adjacent to and above the lugged registration belt 68. The speeder belt 70 rotates clockwise at a higher speed than the lugged registration belt 68. The positioning and rotation of the lugged registration belt 68 and speeder belt 70 ensures that the leading edge of a separated signature 28 is engaged with the corresponding registration lug 72. Once the signature 28 is engaged to the registration lug 72, the signature 28 is in registration, thereby facilitating proper positioning of the subsequent ink jet printing. The use of registration belts and speeder belts is conventional and is generally set forth in U.S. Pat. No. 5,100,116.

The printer device 50 includes an upper belt 74, a lower belt 76, and an ink jet printer 78. The upper belt 74 rotates clockwise at a constant speed. The upper belt 74 is supported so that the printer apparatus 50 can accommodate signatures 28 of varying thicknesses. The lower belt 76 rotates counterclockwise, opposite the direction of the upper belt 74 and at a constant speed equal to that of the upper belt 74. The positioning and rotation of the upper belt 74 and lower belt 76 maintains the registration of each signature 28 in the separated stream 26, as achieved in the operation of the registration device 48. The lower belt 76 can include registration lugs 77 to maintain such registration.

The upper belt 74 and the lower belt 76 are shaped and positioned to expose all but the outermost edges of the separated signature 28 to the ink jet printer 78. The ink jet printer 78 includes numerous ink jet printer heads 80 that are positioned on both the upper side and lower side of the printer apparatus 50 and the separated stream 26. In the illustrated embodiment, the ink jet printer comprises a Videojet SR-50 available from Videojet Systems International, Inc.

Figure 5:
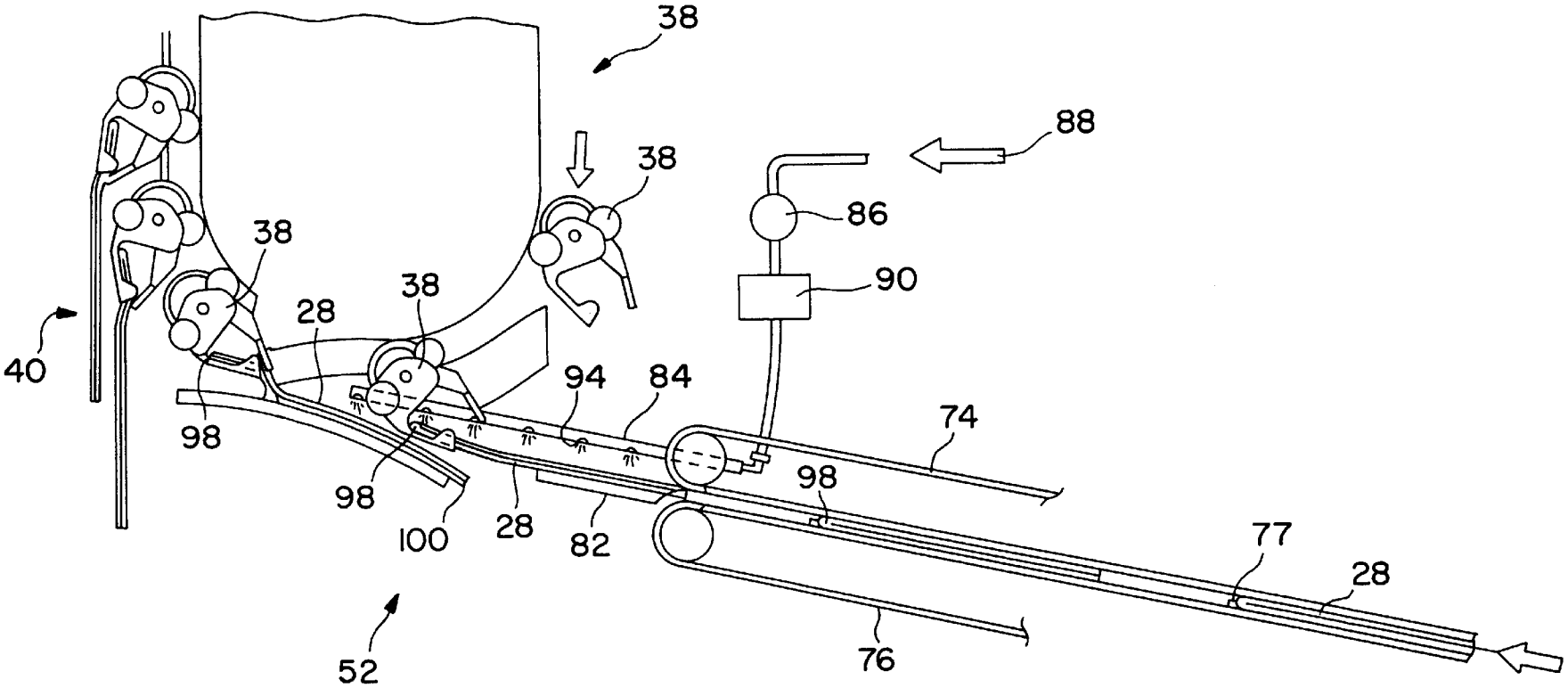
FIG. 5 is an enlarged side elevation view of the gripper entry device.

Referring to FIG. 5, the gripper entry device 52 includes a lower guide 82, an air guide bar 84, a solenoid controlled valve 86, an L.P. air supply 88, a solenoid 90, and a leading edge guide 92. The lower guide 82 is movable and extends from the lower belt 76 toward the gripper conveyor 38. Positioned above the lower guide 82 and extending from the upper belt 74 is an air guide bar 84. The air guide bar 84 has a plurality of openings 94 in its bottom side. A supply of low pressure air 88 with the solenoid controlled valve 86 communicates with the air guide bar 84. A solenoid 90 controls the valve 86 to release a flow of air into the air guide bar 84 to be expelled out of the openings 94. The leading edge guide 92 is positioned below the gripper conveyor 38. The leading edge guide 92 is shaped so that the leading edge of the signatures 28 will be fed into the gripper conveyor 38 and gripped by a corresponding gripper element 96 after exiting the printer apparatus 50. The lower guide 82 is positioned so that when the leading edge 98 of a signature 28 is engaged in the gripper element 96, the trailing edge 100 of the same signature has dropped off of the lower guide 82. With this configuration, a subsequent blast of air from the air guide bar 84 will force the trailing edge 100 of the signature 28 downward to allow the following signature 28 to overlap and be fed into the next gripper element 96.

For purposes of example, the following discussion of the operation of the present invention focuses on a single signature 28 as it is processed through the apparatus illustrated in FIGS. 2–4. Each following signature 28 is processed in the same manner as the exemplary signature 28.

Referring to FIG. 2, a shingled stream 26 of signatures 28 is received by the high speed feeder 24 at the infeed area 30, as is known in the art. The high speed feeder 24 transports the shingled stream 26 along a conveyor belt system to the outfeed area 32. Referring to FIG. 3, the shingled stream 26 then enters the accelerator device 46. The side guides 44 of the outfeed area 32 ensure that the signatures 28 are maintained in proper orientation. The transport belt 54 and associated roller 56 receive the shingled stream 26 from the outfeed area 32 and supply the shingled stream 26 to the first accelerating belt 58 and associated first pinch belt 60.

The first accelerator belt 58 and associated first pinch belt 60 engage the leading edge 98 of the signatures 28, one at a time, and accelerate the signatures 28 to about three times their incoming speed. Similarly, the second accelerator belt 62 and associated second pinch belt 64 further accelerate the signatures 28 to about three times their incoming speed. When the signatures 28 exit the accelerator device 46, the signatures 18 are in a separated stream 36 so that there is no overlap.

Each signature 28 is then drawn into the registration apparatus 48. The higher speed of the speeder belt 70 forces each signature 28 forward, ahead of the rotation of the lugged registration belt 68, until the leading edge 98 of the signature 28 engages the registration lug 72 supported by the lugged registration belt 68. The engagement of the signature 28 with the registration lug 72 places the signature 28 in registration so that proper positioning of the subsequent printing operation is facilitated.

The signature 28 then enters the printer device 50. The rotation and position of the upper and lower belts 74, 76 maintains the signature 28 in registration, as achieved in the operation of the registration device 48. The belts 74 and 76 are shaped and positioned so that all but the outermost edges of the signature 18 are exposed to the ink jet printer 78. As the separated stream 36 of signatures 28 passes between the printer heads 80, the desired printing is performed on the signature 18.

Referring to FIG. 5, the signature 28 is fed from the printer device 50 to the gripper conveyor 38 via the gripper entry device 52. The friction on the upper and lower belts 74, 76 moves the signature 28 leftward. As the leading edge 98 of a signature 28 exits the upper and lower belts 74, 76, it is supported by the lower guide 82. As the signature 28 continues to move leftward and passes the end of the lower guide 82, the leading edge 98 of the signature 28 is supported by the leading edge guide 92. The signature 28 continues to move leftward until it is gripped by a corresponding gripper element 96 on the gripper conveyor 38.

After the leading edge 98 of the signature 28 has been gripped by the corresponding gripper element 96, the trailing edge 100 of the signature 28 moves beyond the end of the lower guide 82. At this time, the solenoid 90 opens the valve 86 in the air supply 88, causing an amount of air to be released through the air guide bar 84 and out of the openings 94. The pressure of the air forces the trailing edge 100 of the signature 28 downward so that the leading edge 98 of a following signature 28 does not move below the leading signature 28 as it is decelerated by the gripper conveyor 38. The following signature 28 is then gripped by a following gripper element 96. The gripper conveyor 38 rotates at a gripper speed that is slower than the stream speed of the separated stream 36. The slower gripper speed causes the gripped signatures 28 to decelerate and form a shingled stream 40. The signatures 28 are thus arranged back into a shingled relation by the gripper conveyor 38.

Subsequent processing of the signatures can be conventional in nature. In the illustrated embodiment, the signatures are fed to a rotary gatherer.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

I claim:

1. An apparatus for providing printed products to a gatherer, said apparatus comprising:

a product supplier for feeding printed products;

a product separator positioned to receive printed products from said product supplier and to separate the printed products into a separated stream;

a printer positioned adjacent to the separated stream and positioned to print on the separated printed products; and a gripper conveyor positioned to receive the separated printed-products from said printer and to form a shingled stream, said gripper conveyor being positioned to provide the shingled products to the gatherer.

2. An apparatus as set forth in claim 1, wherein the printed products are supplied to said product separator at a first speed, and wherein said product separator includes an accelerator belt moving at a second speed greater than said first speed.

3. An apparatus as set forth in claim 2, wherein said product separator includes an additional accelerator belt moving at a third speed greater than said second speed.

4. An apparatus as set forth in claim 1, wherein said printer includes an ink jet printer.

5. An apparatus as set forth in claim 4, wherein said printer includes an ink jet printer positioned on each side of the separated stream.

6. An apparatus as set forth in claim 1, further comprising a lower guide positioned to support the printed products as the printed products are fed from said printer to said gripper conveyor.

7. An apparatus as set forth in claim 6, further comprising a leading edge guide positioned to guide a leading edge of the printed products into said gripper conveyor.

8. An apparatus as set forth in claim 7, wherein said lower guide and said leading edge guide are spaced from each other.

9. An apparatus as set forth in claim 1, further comprising means for deflecting a trailing edge of the printed products.

10. An apparatus as set forth in claim 9, wherein said means for deflecting includes an air guide operatively positioned between said printer and said gripper conveyor.

11. A method of providing printed products to a gatherer, the method comprising the steps of:

accelerating the printed products into a separated stream;

printing on the printed products while the printed products are separated in the separated stream;

receiving the printed products into a gripper conveyor;

decelerating the printed products into a shingled stream; and providing the printed products to a gatherer.

12. A method as set forth in claim 11, wherein said step of accelerating the printed products includes the steps of:

feeding the printed products in a shingled stream; and separating the printed products to form a separated stream.

13. A method as set forth in claim 11, wherein said step of accelerating the printed products includes the step of positioning the printed products between an accelerator belt and a pinch belt.

14. A method as set forth in claim 11, further comprising the step of engaging the printed products with registration lugs.

15. A method as set forth in claim 11, wherein said step of printing on the printed products includes the step of ink jet printing.

16. A method as set forth in claim 11, wherein said step of receiving the printed products includes the step of feeding the printed products over a lower guide.

17. A method as set forth in claim 11, wherein said step of receiving the printed products includes the step of feeding the printed products over a leading edge guide.

18. A method as set forth in claim 11, wherein said step of receiving the printed products includes the step of deflecting a trailing edge of the printed products.

19. A method as set forth in claim 11, wherein said step of receiving the printed products includes the step of gripping the printed products with gripper elements.

20. A method as set forth in claim 19, wherein said step of decelerating the printed products includes the step of moving the gripper elements at a gripper speed that is slower than a stream speed of the separated stream.

21. An apparatus for receiving printed products from a product supplier and for feeding the printed products to a gripper conveyor, said apparatus comprising:

a product separator positioned to receive printed products from the product supplier and to separate the printed products into a separated stream;

a printer positioned adjacent to the separated stream and positioned to print on the separated printed products;

transport means for transporting the printed products from said printer to the gripper conveyor; and means for deflecting a trailing edge of the printed products after the printed products leave said transport means.

22. An apparatus as set forth in claim 21 wherein said deflecting means includes an air guide operatively positioned between said printer and the gripper conveyor.

23. An apparatus as set forth in claim 21 wherein said product separator receives the printed products from the product supplier at a first speed, and wherein said product separator includes an accelerator belt moving at a second speed greater than said first speed.

24. An apparatus as set forth in claim 23 wherein said product separator includes an additional accelerator belt moving at a third speed greater than said second speed.

25. An apparatus as set forth in claim 21 wherein said printer includes an ink jet printer positioned on each side of the separated stream.

26. An apparatus as set forth in claim 21 further comprising a lower guide positioned to support the printed products as the printed products are fed from said printer toward the gripper conveyor.

27. An apparatus as set forth in claim 26 further comprising a leading edge guide positioned to guide a leading edge of the printed products into the gripper conveyor.

28. An apparatus as set forth in claim 27 wherein said lower guide and said leading edge guide are spaced from each other.

29. An apparatus for receiving printed products from a product supplier and for feeding the printed products to a gripper conveyor, said apparatus comprising:

a product separator positioned to receive printed products from the product supplier and to separate the printed products into a separated stream, said product separator receives the printed products from the product supplier at a first speed, said product separator includes an accelerator belt moving at a second speed greater than said first speed and an additional accelerator belt moving at a third speed greater than said second speed;

a printer positioned adjacent to the separated stream and positioned to print on the separated printed products; and transport means for transporting the printed products from said printer to the gripper conveyor.

30. An apparatus as set forth in claim 29 wherein said printer includes an ink jet printer positioned on each side of the separated stream.

31. An apparatus as set forth in claim 29 further comprising a lower guide positioned to support the printed products as the printed products are fed from said printer toward the gripper conveyor.

32. An apparatus as set forth in claim 31 further comprising a leading edge guide positioned to guide a leading edge of the printed products into the gripper conveyor.

33. An apparatus as set forth in claim 32 wherein said lower guide and said leading edge guide are spaced from each other.

34. An apparatus as set forth in claim 29 further comprising means for deflecting a trailing edge of the printed products.

35. An apparatus as set forth in claim 34 wherein said means for deflecting includes an air guide operatively positioned between said printer and the gripper conveyor.

* * * * *